US009707753B2

(12) United States Patent
Chen et al.

(10) Patent No.: US 9,707,753 B2
(45) Date of Patent: Jul. 18, 2017

(54) PRINTHEAD DIE

(71) Applicant: HEWLETT-PACKARD DEVELOPMENT COMPANY, L.P., Houston, TX (US)

(72) Inventors: Chien-Hua Chen, Corvallis, OR (US); Michael W. Cumbie, Corvallis, OR (US); Silam J. Choy, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/771,008

(22) PCT Filed: Jun. 17, 2013

(86) PCT No.: PCT/US2013/046065
§ 371 (c)(1),
(2) Date: Aug. 27, 2015

(87) PCT Pub. No.: WO2014/133575
PCT Pub. Date: Sep. 4, 2014

(65) Prior Publication Data

US 2016/0009082 A1 Jan. 14, 2016

(30) Foreign Application Priority Data

Feb. 28, 2013 (WO) ..... PCT/US2013/028207
Mar. 20, 2013 (WO) ..... PCT/US2013/033046

(51) Int. Cl.
*B41J 2/14* (2006.01)

(52) U.S. Cl.
CPC ..... *B41J 2/14* (2013.01); *B41J 2/1404* (2013.01); *B41J 2/14129* (2013.01);
(Continued)

(58) Field of Classification Search
CPC ..... B41J 2/1433; B41J 2/14145
(Continued)

(56) References Cited

U.S. PATENT DOCUMENTS 4,521,788 A 6/1985 Kimura
4,633,274 A 12/1986 Matsuda
(Continued)

FOREIGN PATENT DOCUMENTS

CN 1903578 A 1/2007
CN 1903579 A 1/2007
(Continued)

OTHER PUBLICATIONS

Kumar, Aditya et al; Wafer Level Embedding Technology for 3D Wafer Level Embedded Package; Institute of Microelectronics, A*Star; 2Kinergy Ltd, TECHplace II; 2009 Electronic Components and Technology Conference; pp. 1289-1296.
(Continued)

*Primary Examiner* — Julian Huffman
*Assistant Examiner* — Sharon A Polk
(74) *Attorney, Agent, or Firm* — HP Inc.—Patent Department

(57) ABSTRACT

In one example, a printhead die includes a structure having a thickness 100 μm or less and a ratio of length to width of at least 50 and containing, within its thickness, multiple fluid ejectors and multiple fluid chambers each near an ejector and each having an inlet through which printing fluid may enter the chamber and an outlet through which printing fluid may be ejected from the chamber.

18 Claims, 11 Drawing Sheets

(52) U.S. Cl.
CPC ..... *B41J 2/14145* (2013.01); *B41J 2/1433* (2013.01); *B41J 2002/14419* (2013.01); *B41J 2202/20* (2013.01)

(58) Field of Classification Search
USPC ..... 347/44
See application file for complete search history.

(56) References Cited

U.S. PATENT DOCUMENTS

| | | | | |
|---|---|---|---|---|
| 4,873,622 | A | 10/1989 | Komuro et al. | |
| 5,847,725 | A * | 12/1998 | Cleland | B41J 2/14016 347/20 |
| 6,145,965 | A | 11/2000 | Inada et al. | |
| 6,250,738 | B1 | 6/2001 | Waller et al. | |
| 6,554,399 | B2 | 4/2003 | Wong et al. | |
| 6,938,340 | B2 | 9/2005 | Haluzak et al. | |
| 7,490,924 | B2 | 2/2009 | Haluzak et al. | |
| 7,591,535 | B2 | 9/2009 | Nystrom et al. | |
| 7,658,470 | B1 | 2/2010 | Jones et al. | |
| 7,824,013 | B2 | 11/2010 | Chung-Long et al. | |
| 7,877,875 | B2 | 2/2011 | O'Farrell et al. | |
| 8,197,031 | B2 | 6/2012 | Stephens et al. | |
| 8,235,500 | B2 | 8/2012 | Nystrom et al. | |
| 8,246,141 | B2 | 8/2012 | Petruchik et al. | |
| 8,272,130 | B2 | 9/2012 | Miyazaki | |
| 8,287,104 | B2 | 10/2012 | Sharan et al. | |
| 8,342,652 | B2 | 1/2013 | Nystrom et al. | |
| 2002/0041308 | A1* | 4/2002 | Cleland | B23P 15/16 347/47 |
| 2004/0032468 | A1 | 2/2004 | Killmeier et al. | |
| 2005/0024444 | A1 | 2/2005 | Conta et al. | |
| 2009/0011185 | A1* | 1/2009 | Giri | B41J 2/14145 428/136 |
| 2009/0225131 | A1 | 9/2009 | Chen et al. | |
| 2009/0256891 | A1* | 10/2009 | Anderson | B41J 2/1603 347/61 |
| 2010/0156989 | A1* | 6/2010 | Petruchik | B41J 2/14024 347/44 |
| 2010/0220148 | A1 | 9/2010 | Menzel | |
| 2010/0271445 | A1 | 10/2010 | Sharan et al. | |
| 2010/0302311 | A1* | 12/2010 | Blair | B41J 2/155 347/42 |
| 2011/0019210 | A1 | 1/2011 | Chung et al. | |
| 2011/0037808 | A1 | 2/2011 | Ciminelli et al. | |
| 2011/0141691 | A1 | 6/2011 | Slaton et al. | |
| 2011/0222239 | A1 | 9/2011 | Dede | |
| 2011/0292126 | A1 | 12/2011 | Nystrom et al. | |
| 2011/0298868 | A1 | 12/2011 | Fielder et al. | |
| 2012/0019593 | A1 | 1/2012 | Scheffelin et al. | |
| 2012/0124835 | A1 | 5/2012 | Okano et al. | |
| 2012/0186079 | A1 | 7/2012 | Ciminelli | |
| 2012/0210580 | A1 | 8/2012 | Dietl | |
| 2012/0212540 | A1 | 8/2012 | Dietl | |

FOREIGN PATENT DOCUMENTS

| | | | |
|---|---|---|---|
| CN | 101085573 | A | 12/2007 |
| CN | 101163591 | A | 4/2008 |
| CN | 101274514 | A | 10/2008 |
| CN | 101274515 | A | 10/2008 |
| CN | 102689511 | A | 9/2012 |
| CN | 102689512 | A | 9/2012 |
| EP | 1095773 | | 7/2003 |
| JP | 2001071490 | | 3/2001 |
| JP | 2002291262 | A | 10/2002 |
| JP | 2006321222 | | 11/2006 |
| JP | 2010137460 | | 6/2010 |
| WO | WO-2012134480 | | 10/2012 |

OTHER PUBLICATIONS

Lee et al; A Thermal Inkjet Printhead with a Monolithically Fabricated Nozzle Plate and Self-aligned Ink Feed Hole; Journal of Microelectromechanical Systems; vol. 8, No. 3; Sep. 1999; pp. 229-236.

* cited by examiner

PRINTHEAD DIE

BACKGROUND

Each printhead die in an inkjet pen or print bar includes tiny channels that carry ink to the ejection chambers. Ink is distributed from the ink supply to the die channels through passages in a structure that supports the printhead die(s) on the pen or print bar. It may be desirable to shrink the size of each printhead die, for example to reduce the cost of the die and, accordingly, to reduce the cost of the pen or print bar. The use of smaller dies, however, can require changes to the larger structures that support the dies, including the passages that distribute ink to the dies.

DRAWINGS

The same part numbers designate the same or similar parts throughout the figures. The figures are not necessarily to scale. The size of some parts is exaggerated to more clearly illustrate the example shown.

DESCRIPTION

Inkjet printers that utilize a media wide print bar have been developed to help increase printing speeds and reduce printing costs. Conventional media wide print bar assemblies include multiple parts that carry printing fluid from the printing fluid supplies to the small printhead dies from which the printing fluid is ejected on to the paper or other print media. While reducing the size and spacing of the printhead dies continues to be important for reducing cost, channeling printing fluid from the larger supply components to ever smaller, more tightly spaced dies requires complex flow structures and fabrication processes that can actually increase overall cost.

A new fluid flow structure has been developed to enable the use of smaller printhead dies to help reduce cost in printhead assemblies for media wide and other inkjet printers. Examples of the new fluid flow structure and processes for making such structures are disclosed in international patent application PCT/US2013/028207 filed Feb. 28, 2013 and PCT/US2013/033046 filed Mar. 20, 2013, each of which is incorporated herein by reference in its entirety.

A printhead implementing one example of the new structure includes multiple printhead dies molded into an elongated, monolithic body of moldable material. Printing fluid channels molded into the body carry printing fluid directly to flow passages in each die. The molding in effect grows the size of each die for making external fluid connections and for attaching the dies to other structures, thus enabling the use of smaller dies. The printhead dies and printing fluid delivery channels can be molded at the wafer level to form a composite printhead wafer with built-in printing fluid channels, eliminating the need to form the printing fluid channels in a silicon substrate and enabling the use of thinner, longer and narrower dies. Very thin long, narrow printhead die "slivers" are now possible. In one example, a new printhead die includes a structure having a thickness of 100 μm or less containing multiple fluid ejectors and multiple fluid ejection chambers with a ratio of length to width of 50 or more. In one specific implementation of this example, the die structure is 25 mm long (or longer) and not more than 200 μm wide and is embedded in a molding with a printing fluid delivery channel that is only about 90 μm wide.

These and other examples shown in the figures and described below illustrate but do not limit the invention, which is defined in the Claims following this Description.

As used in this document, a "printhead" and a "printhead die" mean that part of an inkjet printer or other inkjet type dispenser that dispenses fluid from one or more openings. A printhead includes one or more printhead dies. "Printhead" and "printhead die" are not limited to printing with ink and other printing fluids but also include inkjet type dispensing of other fluids and/or for uses other than printing.

Figure 1:
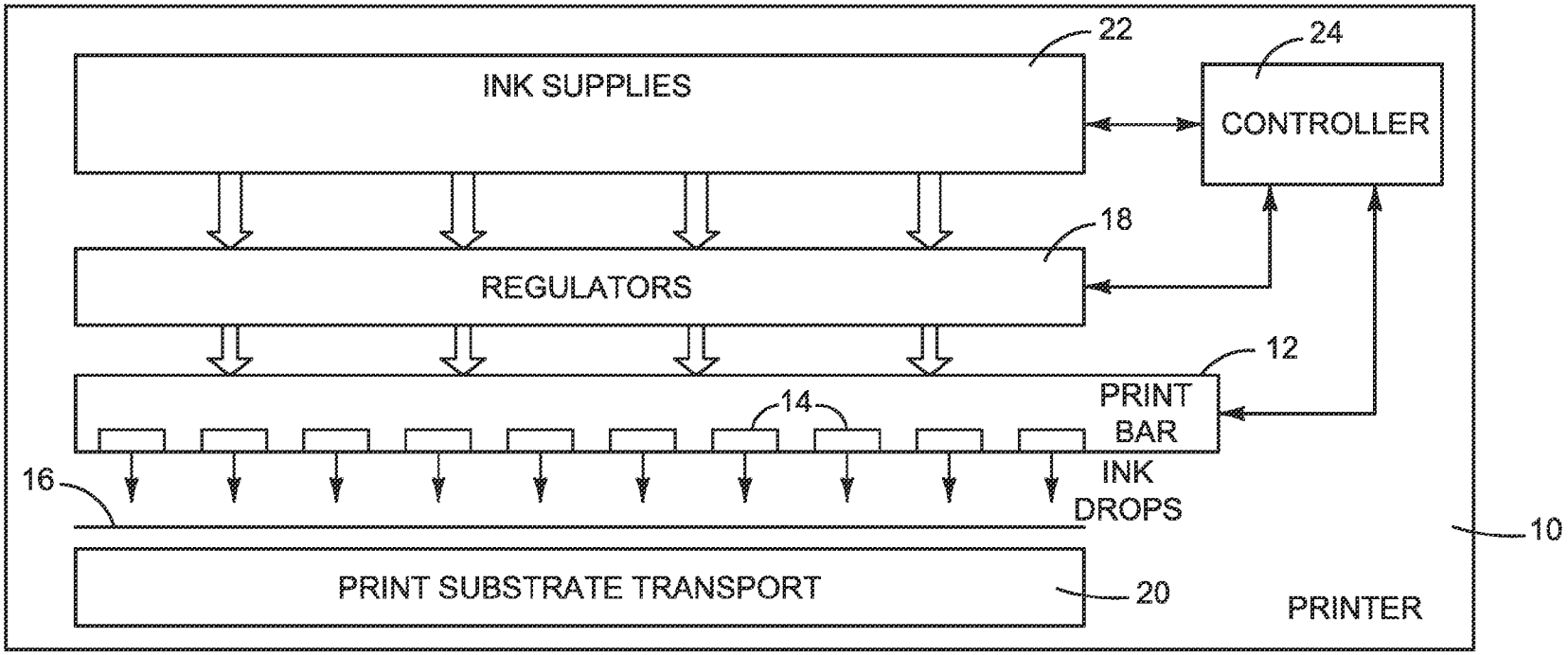
FIG. 1 is a block diagram illustrating an inkjet printer with a media wide print bar implementing one example of a new printhead.
Figure 2:
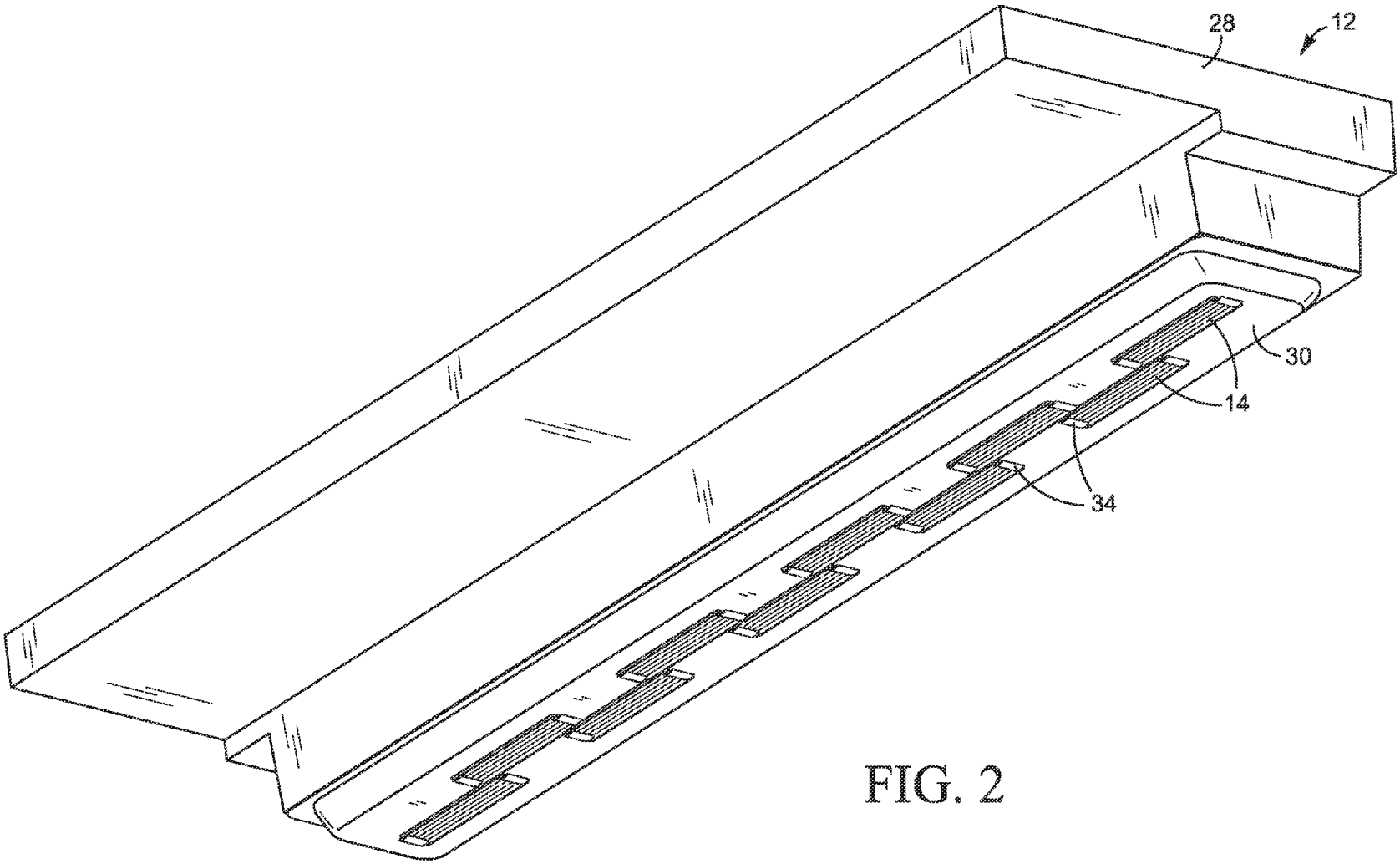
FIGS. 2 and 3 are perspective views of one example of a print bar such as might be used in the printer shown in FIG. 1.
Figure 3:
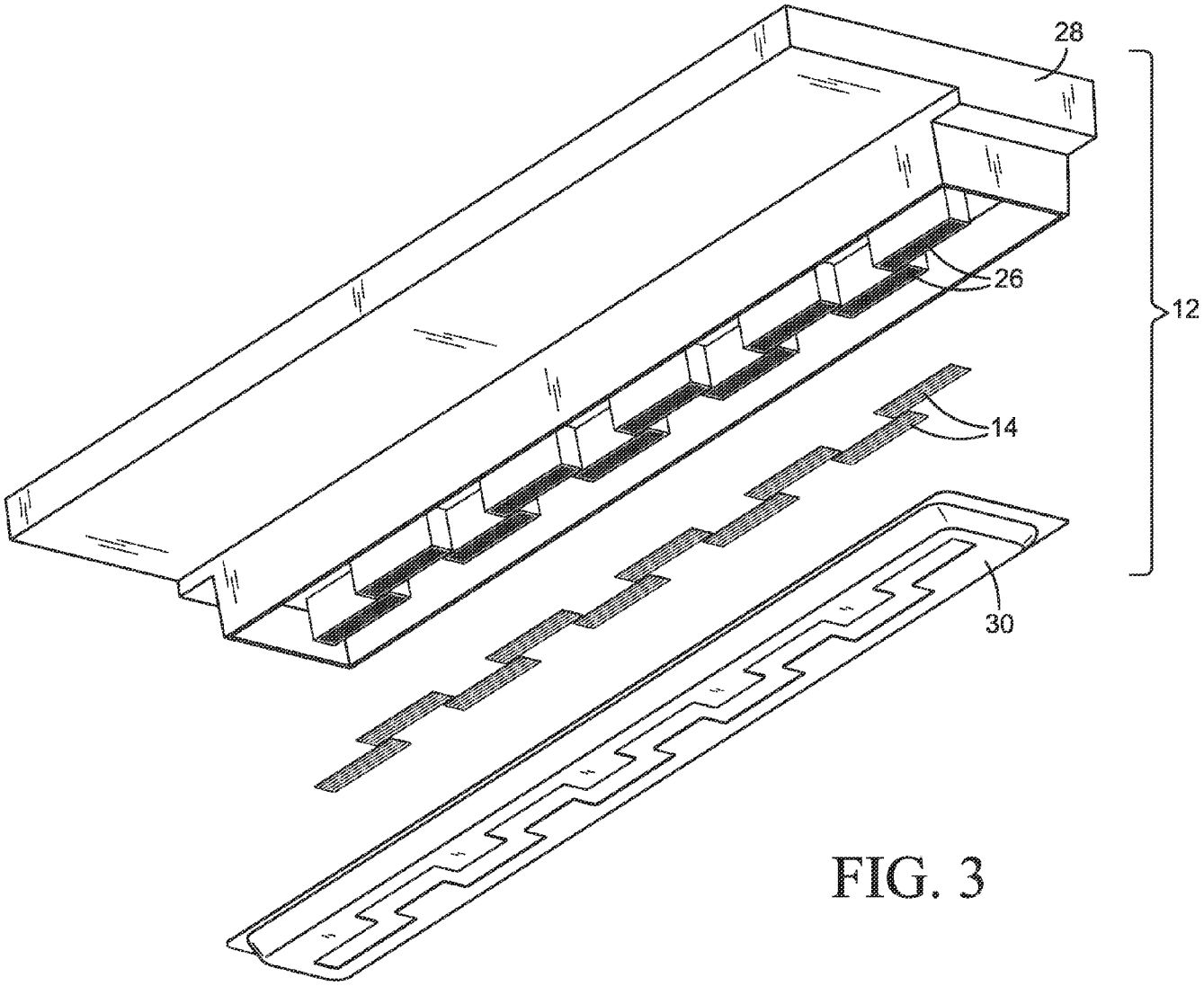
Figure 4:
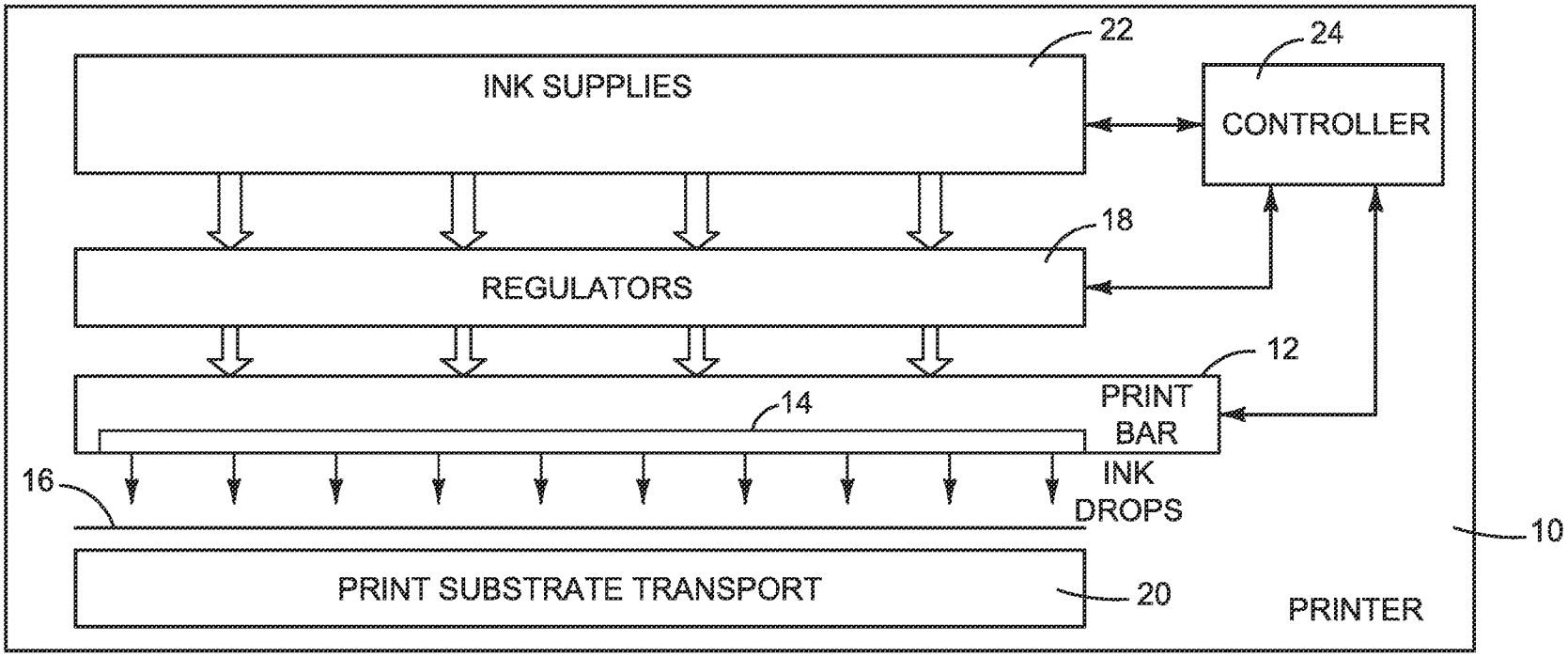
FIG. 4 is a block diagram illustrating an inkjet printer with a media wide print bar implementing another example of a new printhead.

FIGS. 1 and 4 are block diagrams illustrating an inkjet printer 10 with a page wide print bar 12 implementing a new printhead 14. In the printer 10 shown in FIG. 1, print bar 12 includes multiple printheads 14. In the printer 10 shown in FIG. 4, print bar 12 includes a single, page wide printhead 14. FIGS. 2 and 3 are perspective views of a print bar 12 with multiple printheads 14 such as might be used in printer 10 shown in FIG. 1 FIGS. 5 and 6 are perspective views of a print bar 12 with a single printhead 14 such as might be used in printer 10 shown in FIG. 4.

Referring first to FIGS. 1 and 4, printer 10 includes a print bar 12 spanning the width of a print media 16, flow regulators 18 associated with print bar 12, a media transport mechanism 20, ink or other printing fluid supplies 22, and a printer controller 24. Controller 24 represents the programming, processor(s) and associated memory(ies), and the electronic circuitry and components needed to control the operative elements of a printer 10. Print bar 12 includes an arrangement of molded printhead(s) 14 for dispensing printing fluid on to a sheet or continuous web of paper or other print media 16. Print bar 12 in FIG. 1 includes multiple molded printheads 14 spanning print media 16. Print bar 12 in FIG. 4 includes a single molded printhead 14 spanning print media 16. As described in detail below, each printhead 14 includes multiple printhead dies embedded in a molding with channels that feed printing fluid to each die in a flow path from supplies 22 through flow regulators 18 to print bar 12.

In the example of print bar 12 shown in FIGS. 2 and 3, multiple printheads 14 are arranged in a row lengthwise across the print bar in a staggered configuration in which each printhead overlaps an adjacent printhead. (Although ten printheads 14 are shown in a staggered configuration, more or fewer printheads 14 may be used and/or in a different configuration.) Each printhead 14 is mounted to a platform or other suitable mounting structure 26 on a print bar body 28 and partially surrounded by a shroud 30. In the example of print bar 12 shown in FIGS. 5 and 6, a single page wide printhead 14 is mounted to structure 26. In addition to providing a mounting platform 26 for printhead (s) 14, print bar body 28 may also include or house pathways and flow regulators for delivering printing fluids to printhead (s) 14. Also, while mounting platform 26 is shown as an integral part of body 28, platform 26 could also be formed as a discrete part supported in or on body 28.

Figure 5:
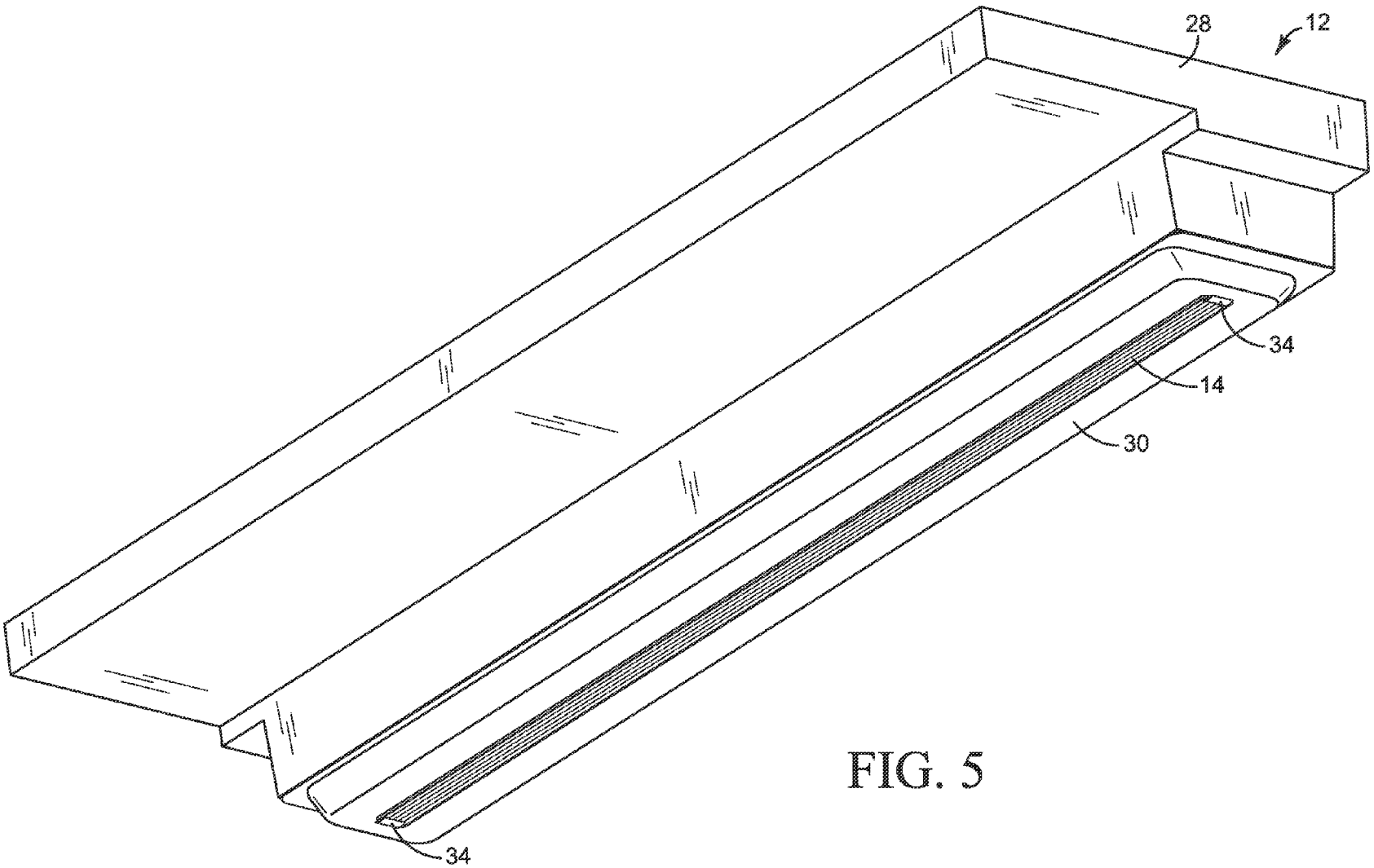
FIGS. 5 and 6 are perspective views of one example of a print bar such as might be used in the printer shown in FIG. 4.
Figure 6:
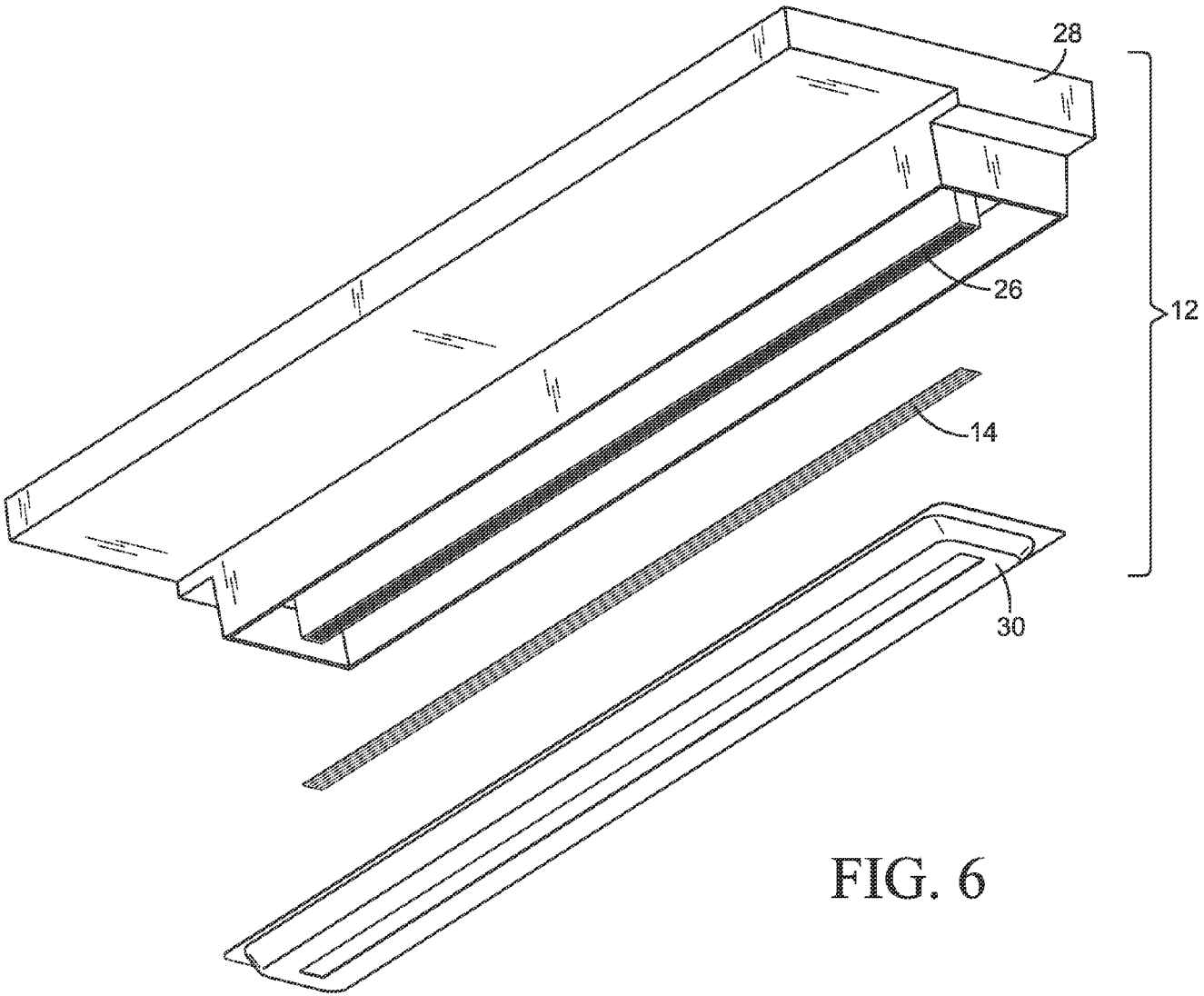
Figure 7:
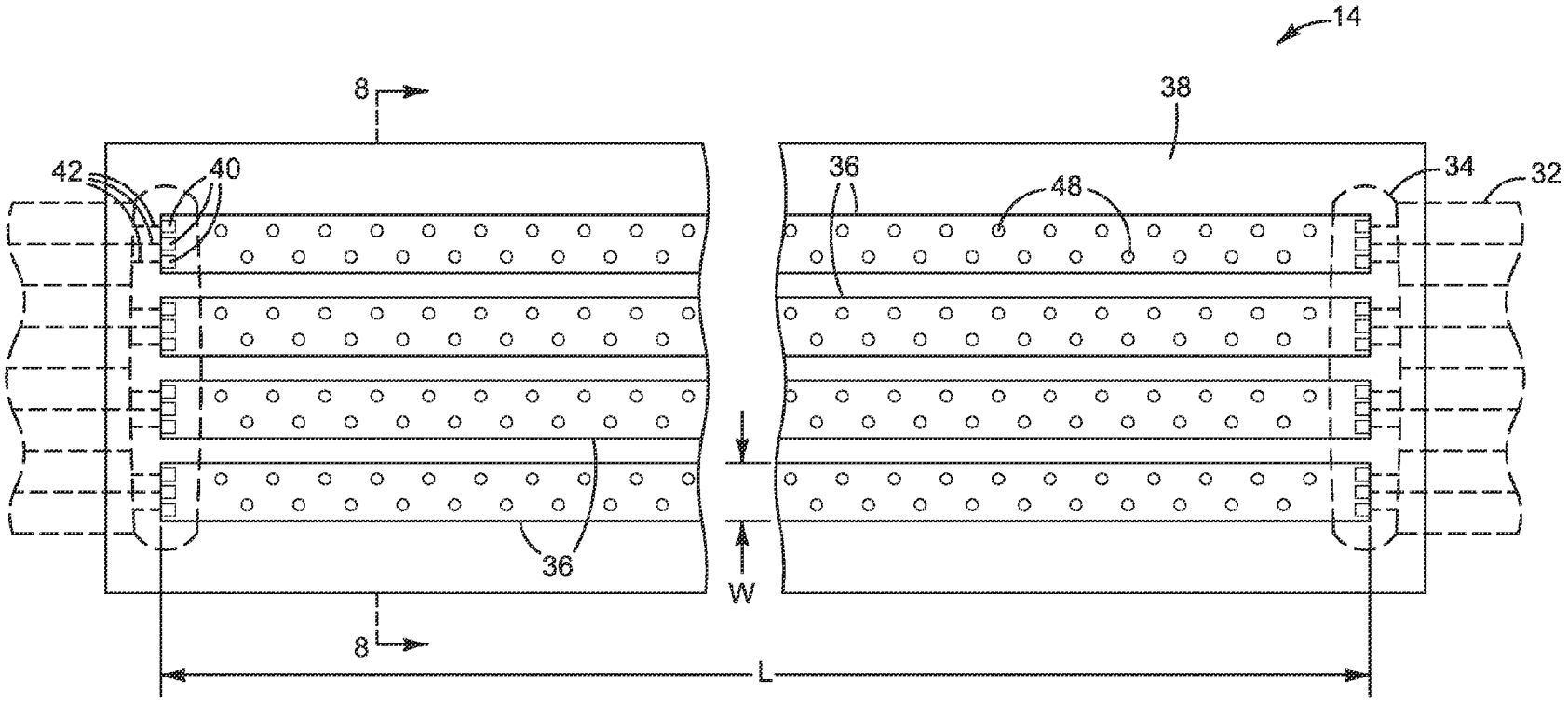
FIG. 7 is a close-up view of one example of a printhead in the print bar shown in FIGS. 1-3 or FIGS. 4-6.
Figure 8:
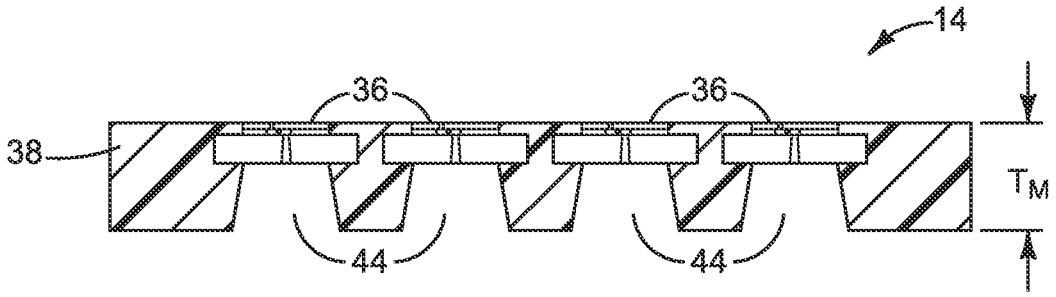
FIG. 8 is a section view taken along the line 8-8 in FIG. 7.

FIG. 7 is a close-up view of one of the printheads 14 in the print bar 12 shown in FIGS. 2 and 3 or the single printhead 14 shown in FIGS. 5 and 6. FIG. 8 is a section view taken along the line 8-8 in FIG. 7. As noted above, one of the advantages of the new molded printhead structure is that it enables the use of very thin long, narrow printhead dies desirable for a single page wide printhead such as that shown in FIGS. 5 and 6 and for covering large format print media with a multiple printhead print bar such as that shown in FIGS. 2 and 3. And, of course, the new smaller printhead dies are suitable for use in shorter printheads as well.

Referring now to FIGS. 7 and 8, printhead 14 includes printhead dies 36 embedded in a monolithic molding 38 and arranged parallel to one another across the width of molding 38. Molding 38 is sometimes referred to herein as a body 38 of moldable material. Although four parallel dies 36 are shown, for printing four different ink colors for example, more or fewer printhead dies 36 and/or in other configurations are possible. Bond pads 40 connect electronic circuitry in each printhead die 36 to external components through bond wires 42 and printed circuit boards or flex circuits 32. Flex circuits 32 and epoxy or other protective coverings 34 are depicted with dotted lines in FIG. 7 to more clearly show the underlying structures. Printhead 14 also includes channels 44 molded into monolithic body 38 to deliver printing fluid directly to respective printhead dies 36.

Figure 9:
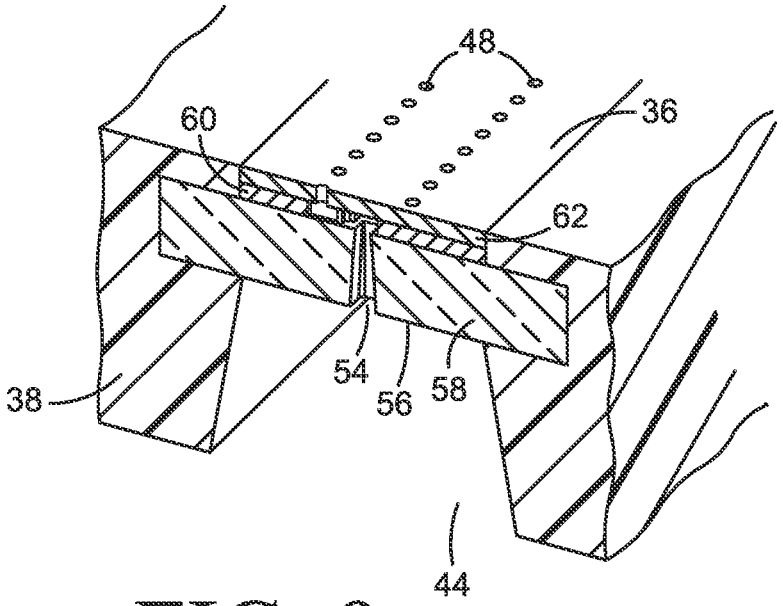
FIGS. 9 and 10 are detail views from FIG. 8.
Figure 10:
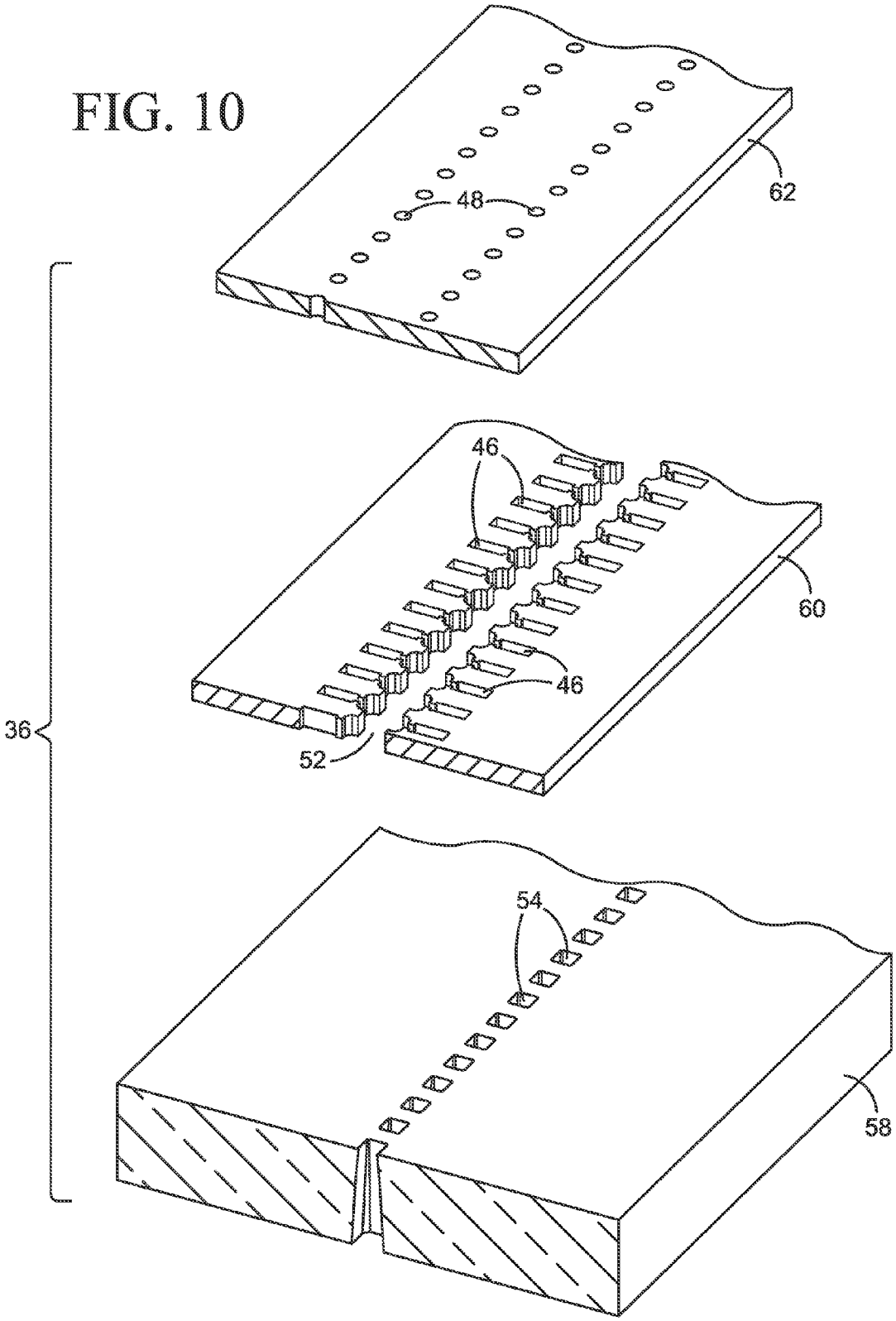
Figure 11:
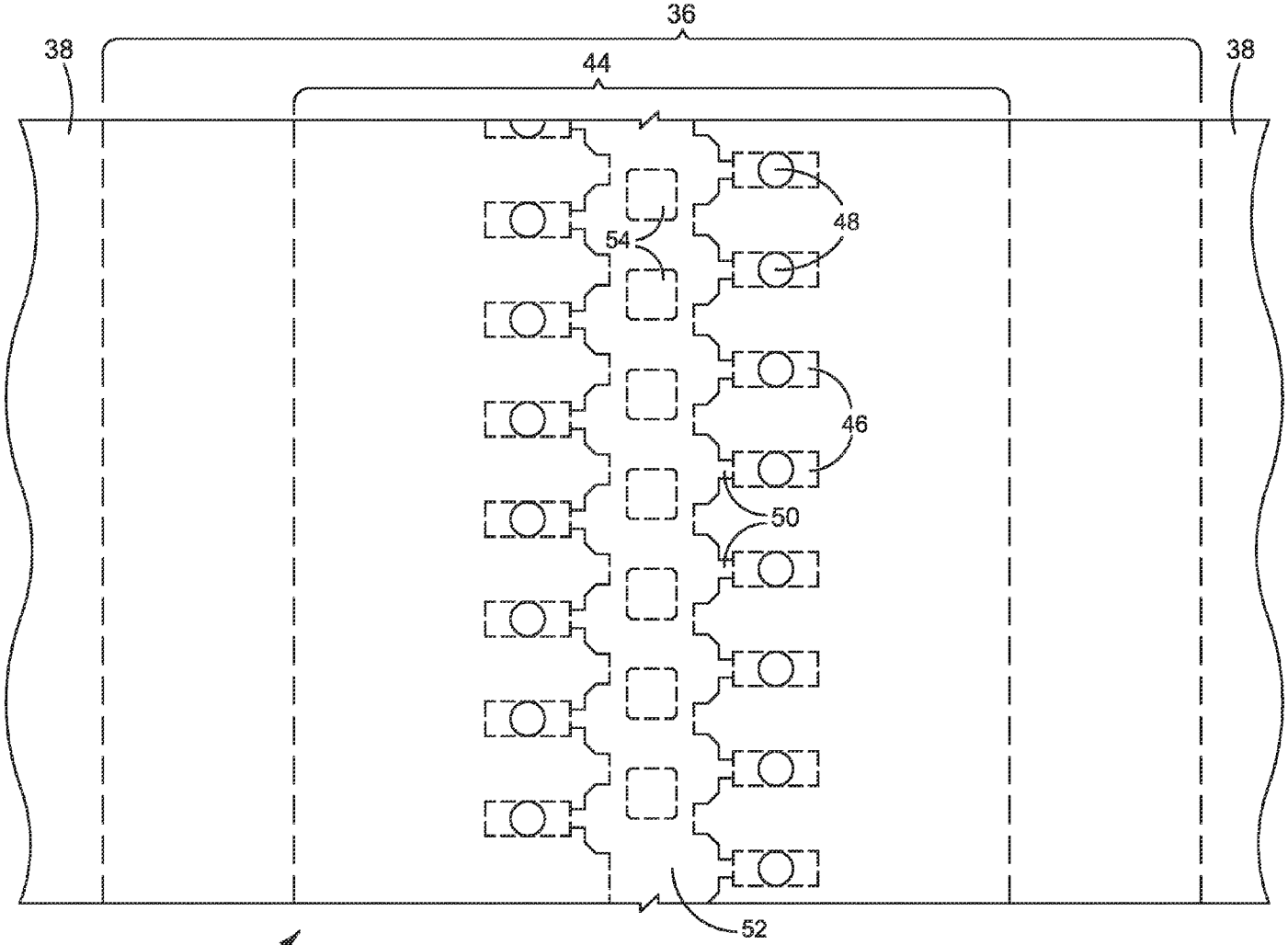
FIG. 11 is a plan view diagram showing the layout of some of the features of each printhead die from FIGS. 7-8.

FIGS. 9 and 10 are detail views from FIG. 8. FIG. 11 is a plan view diagram showing the layout of some of the features of each printhead die 36 from FIGS. 7-10. Referring now also to FIGS. 9-11, in the example shown, each printhead die 36 includes two rows of ejection chambers 46 and corresponding nozzles 48 through which printing fluid is ejected from chambers 46. Each channel 44 in molding 38 supplies printing fluid to one printhead die 36. Other suitable configurations for printhead dies 36 are possible. For example, more or fewer ejection chambers 46 and channels 44 could be used. Printing fluid flows into each ejection chamber 46 through an inlet 50 from a manifold 52 extending lengthwise along each die 36 between the two rows of ejection chambers 46. Printing fluid feeds into manifold 52 through multiple ports 54 that are connected to a printing fluid supply channel 44 at die surface 56.

Printing fluid supply channel 44 is substantially wider than printing fluid ports 54, as shown, to carry printing fluid from larger, loosely spaced passages in the flow regulator or other parts that carry printing fluid into print bar 12 to the smaller, tightly spaced printing fluid ports 54 in printhead die 36. Thus, printing fluid supply channels 44 can help reduce or even eliminate the need for a discrete "fan-out" fluid routing structure necessary in some conventional printheads. In addition, exposing a substantial area of printhead die surface 56 directly to channel 44, as shown, allows printing fluid in channel 44 to help cool die 36 during printing.

Figure 12:
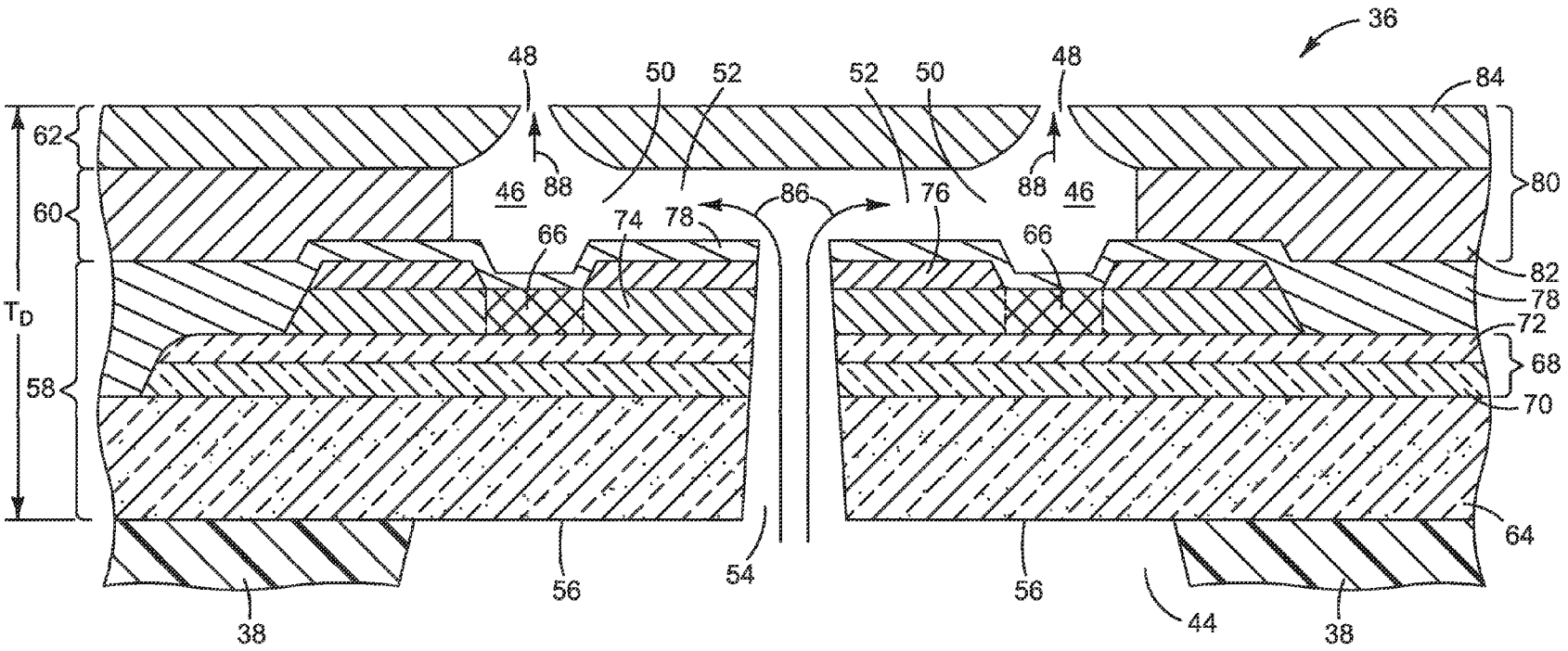
FIG. 12 is a section view showing the printhead die from FIGS. 9-11 in more detail.

The idealized representation of a printhead die 36 in FIGS. 8-11 depicts three layers 58, 60, 62 for convenience only to clearly show ejection chambers 46, nozzles 48, manifold 52, and ports 54. An actual inkjet printhead die 36 is a typically complex integrated circuit (IC) structure formed on a silicon substrate 58 with layers and elements not shown in FIGS. 8-11. For example, and referring to the section view of FIG. 12, a printhead die 36 for thermal inkjet printing utilizes a layered architecture that includes a silicon or other suitable substrate 64, fluid ports 54 formed in substrate 64, resistive heating elements 66 that eject ink from chambers 46 through nozzles 48. (The section view line of FIG. 12 is adjusted so that two opposing ejection chambers 46 are both visible.) FIG. 12 also presents an idealized representation of a printhead die 36 that is not to scale. The relative size of some parts is exaggerated for clarity. For example, the overall thickness of die 36 relative to its width is much smaller than that shown in FIG. 12, nozzles 48 are much smaller too, with hundreds or thousands of nozzles 48 on each printhead die 36, and a particular layer in FIG. 12 may appear to be thicker than its actual thickness when compared to another layer.

Printhead 36 shown in FIG. 12 includes a dielectric 68 formed on substrate 64. In the example shown, dielectric 68 is a patterned thin film that includes two layers formed on substrate 64—a TEOS (tetraethyl orthosilicate) layer 70 and a BPSG (borophosphosilicate glass) layer 72 overlaying TEOS layer 70. Other materials may also be suitable for dielectric 68. Resistors 66 are formed in a resistive layer 74 over dielectric 68. A typical resistive layer 74 is, for example, made of tungsten silicide nitride (WSiN), tantalum silicide nitride (TaSiN), tantalum aluminum (TaAl), tantalum nitride (Ta2N), or combinations of these materials. A conductive layer 76 formed on (or under) resistive layer 74 can be used to supply current to resistors 66 and/or to couple resistors 66 to a control circuit or other electronic circuits in printhead die 36. A typical conductive layer 76 is, for example, made of platinum (Pt), aluminum (Al), tungsten (W), titanium (Ti), molybdenum (Mo), palladium (Pd), tantalum (Ta), nickel (Ni), copper (Cu) with an inserted diffusion barrier, and combinations of these materials. A passivation layer 78 is formed over conductive layer 76 as a dielectric and as a barrier against cavitation (in ejection chambers 46), oxidation, corrosion, and other environmental conditions. A typical passivation layer 78 is, for example, made of silicon carbide (SiC), silicide nitride (SiN), TEOS, and combinations of these materials.

Continuing to refer to FIG. 12, nozzles 48 are formed in a nozzle plate 80 formed on or affixed to the underlying structure described above. Nozzle plate 80 helps define ejection chambers 46, inlets 50, and manifold 52. In the example shown, nozzle plate 80 is formed in two layers—a first layer 82 formed on passivation layer 78 and a second layer 84 formed on first layer 82. While both layers 82, 84 help define ejection chamber 46 in this example, nozzles 48 are formed in the outermost, second layer 84. Each nozzle plate layer 82, 84 is made of an SU8 epoxy polymer or other suitable material. First layer 82 is sometimes referred to as the "chamber" layer because it forms the sidewall of ejection chamber 46. Second layer 84 is sometimes referred to as the "nozzle" layer because nozzles 48 are formed in this layer. In operation, ink or other printing fluid feeds into chambers 46 from channel 44 through ports 54 as indicated by flow arrows 86. A resistor 66 is energized to heat the ink in the corresponding chamber 46 to create a bubble that forces ink out of nozzle 48, as indicated by flow arrow 88.

A molded printhead 14 enables the use of long, narrow and very thin printhead dies 36. While a 100 μm thick printhead die 36 with an aspect ratio of 50 is believed to be new, it has been shown that a 100 μm thick printhead die 36 that is about 25 mm long and 200 μm wide can be molded into a 500 μm thick molding 38 with 90 μm wide channels 44—a die length to width ratio of 120, which is almost 2½ times that of even the smallest dies now available in conventional printheads. The thickness of printhead die 36 is indicated by dimension $T_D$ in FIG. 12. The length and width of printhead die 36 is indicated by dimensions L and W in FIG. 7. The thickness of molding 38 is indicated by dimension $T_M$ in FIG. 8. Not only is it cheaper and easier to mold channels 44 into molding 38 compared to forming the feed channels in a silicon substrate, but it is also cheaper and easier to form printing fluid ports 54 in a thinner die 36. (Tapered ports 54 help move air bubbles away from manifold 52 and ejection chambers 46.) For example, ports 54 in a 100 μm thick printhead die 36 may be formed by dry etching and other suitable micromachining techniques not practical for thicker substrates. Micromachining a high density array of straight or slightly tapered through-ports 54 in a thin silicon, glass or other structure 58, rather than forming conventional slots, leaves a stronger structure while still providing adequate printing fluid flow. Thus, a molded printhead 14 enables the use of very thin long, narrow dies 36 while still controlling the risk of "die-fragility" damage—damage that usually arises from the propagation of cracks that form during silicon slotting.

It is expected that current die handling equipment and micro device molding tools and techniques can adapted to mold dies 36 as thin as 50 μm, with a length/width ratio up to 150, and to mold channels 44 as narrow as 30 μm. Molding 38 provides an effective but inexpensive structure in which multiple rows of such die "slivers" 36 can be supported in a single, monolithic body. The die slivers can be spaced within the molding to eliminate the need for a discrete ink channel fan-out structure used in conventional printheads.

As noted at the beginning of this Description, the examples shown in the figures and described above illustrate but do not limit the invention. Other examples are possible. Therefore, the foregoing description should not be construed to limit the scope of the invention, which is defined in the following claims.

What is claimed is:

1. A printhead die, comprising a structure having a thickness of 100 μm or less and a ratio of length to width of at least 50, the structure containing, within its thickness, multiple fluid ejectors and multiple fluid chambers each near an ejector and each having an inlet through which printing fluid may enter the chamber and an outlet through with printing fluid may be ejected from the chamber.

2. The printed die of claim 1, wherein the structure is at least 25 mm long and less than or equal to 200 μm wide.

3. The printed die of claim 2, further comprising a molding, the structure embedded in the molding and the molding having a channel therein through which printing fluid may pass directly to the structure.

4. The printed die of claim 3, wherein the channel has a width of 90 μm or less.

5. The printhead die of claim 4, wherein the structure also contains within its thickness:

multiple ports connected to the channel such that printing fluid can flow from the channel directly into the ports; and a manifold connected between the ports and the inlets such that printing fluid can flow from the ports directly into the manifold to the inlets.

6. The printhead die of claim 5, wherein each port is tapered from a broader part at the channel to a narrower part at the manifold.

7. The printhead die of claim 6, wherein the channel is tapered from a broader part away from the ports to a narrower part at the ports.

8. The printhead of claim 5, wherein a width of the ports is less than a width of the channel and the width of the ports is less than a width of the manifold.

9. A printhead, comprising a printhead die having a thickness 100 μm or less molded into a monolithic body with a channel therein through which printing fluid may pass directly to the die.

10. The printhead of claim 9, wherein the printhead die has a generally rectangular perimeter characterized by a ratio of length to width of at least 50.

11. The printhead of claim 10, wherein the body has a thickness of 500 μm or less.

12. The printhead of claim 11, wherein the printhead die comprises multiple printhead dies each having a thickness 100 μm or less and a generally rectangular perimeter characterized by a ratio of length to width of at least 50, the printhead dies arranged parallel to one another in the body and the channel comprises multiple channels each through which printing fluid may pass to one of the dies.

13. The printhead of claim 12, wherein each channel has a width of 90 μm or less; and each printhead die contains, within its thickness:

multiple fluid ejectors;

multiple fluid chambers each near an ejector, each chamber having an inlet through which printing fluid may enter the chamber and an outlet through which printing fluid may be ejected from the chamber;

multiple ports connected to a channel such that printing fluid can flow from the channel directly into the ports; and a manifold connected between the ports and the inlets such that printing fluid can flow from the ports directly into the manifold to the inlets.

14. The printhead of claim 9, wherein the channel is supplied by a plurality of ports, the plurality of ports having a width that is smaller than a width of the channel.

15. A print bar, comprising:

a mounting structure; and a printhead mounted to the mounting structure, the printhead including multiple printhead dies molded into a monolithic body and arranged parallel to one another in the body and the body having multiple channels therein through which printing fluid may pass directly to the dies, wherein each printhead has a thickness less than or equal to 100 μm and a generally rectangular perimeter characterized by a ratio of length to width of at least 50.

16. The print bar of claim 15, wherein:

each channel has a width of 90 μm or less; and each printhead die contains, within its thickness:

multiple fluid ejectors;

multiple fluid chambers each near an injector, each chamber having an inlet through which printing fluid may enter the chamber and an outlet through which printing fluid may be ejected from the chamber;

multiple ports connected to a channel such that printing fluid can flow from the channel directly into the ports; and a manifold connected between the ports and the inlets such that printing fluid can flow from the ports directly into the manifold to the inlets.

17. The print bar of claim 16, further comprising a shroud.

18. The print bar of claim 15, wherein the printhead comprises multiple printheads arranged generally end to end in a staggered configuration in which each printhead overlaps an adjacent printhead and each printhead includes multiple printhead dies molded into a monolithic body and arranged parallel to one another in the body and each body having multiple channels therein which printing fluid may pass directly to the dies.

* * * * *